US010287796B2

(12) United States Patent
Jin

(10) Patent No.: US 10,287,796 B2
(45) Date of Patent: May 14, 2019

(54) ANTI-STICK ZIPPER COVER, STICK-FREE ZIPPER AND TENT HAVING SAME

(71) Applicant: Campvalley (Xiamen) Co. Ltd., Xiamen (CN)

(72) Inventor: Juyoung Jin, Xiamen (CN)

(73) Assignee: Campvalley (Xiamen) Co., LTD., Xiamen (CN)

( * ) Notice: Subject to any disclaimer, the term of this patent is extended or adjusted under 35 U.S.C. 154(b) by 0 days.

(21) Appl. No.: 15/594,314

(22) Filed: May 12, 2017

(65) Prior Publication Data

US 2018/0220751 A1 Aug. 9, 2018

(30) Foreign Application Priority Data

Feb. 9, 2017 (CN) ..... 2017 2 0118135 U

(51) Int. Cl.

| | |
|---|---|
| ***E04H 15/64*** | (2006.01) |
| ***E04H 15/54*** | (2006.01) |
| ***E04H 15/42*** | (2006.01) |
| ***E04H 15/32*** | (2006.01) |
| ***A44B 19/24*** | (2006.01) |

(52) U.S. Cl.

CPC ..... *E04H 15/64* (2013.01); *A44B 19/24* (2013.01); *E04H 15/32* (2013.01); *E04H 15/42* (2013.01); *E04H 15/54* (2013.01)

(58) Field of Classification Search

CPC ..... E04H 15/54; E04H 15/64; E04H 15/36; E04H 15/32; E04H 2015/326; A44B 19/32; A44B 19/00; A44B 19/382

USPC ..... 135/124, 115, 119; 24/381, 384, 24/399–400, 304, 432

See application file for complete search history.

(56) References Cited

U.S. PATENT DOCUMENTS

| | | | | |
|---|---|---|---|---|
| 2,866,245 | A * | 12/1958 | Elgin | A44B 19/26 24/426 |
| 3,970,096 | A * | 7/1976 | Nicolai | E04H 15/14 135/115 |
| 5,181,299 | A * | 1/1993 | Huang | A44B 19/34 24/381 |
| 6,119,270 | A * | 9/2000 | Chou | A41D 3/00 2/108 |
| 6,216,715 | B1 * | 4/2001 | Howe | E04H 15/14 135/95 |
| 6,651,254 | B1 * | 11/2003 | Chang | A41D 3/04 2/87 |
| 7,293,333 | B2 * | 11/2007 | Stenhall | A44B 19/32 24/389 |
| 7,588,045 | B2 * | 9/2009 | Goodwin | E04H 15/06 135/117 |
| 9,596,826 | B2 * | 3/2017 | Lu | A01K 1/033 |
| 2005/0109382 | A1 * | 5/2005 | Choi | E04H 15/32 135/117 |
| 2010/0269312 | A1 * | 10/2010 | Wagner | A41H 37/003 24/400 |

(Continued)

*Primary Examiner* — Winnie Yip

(74) *Attorney, Agent, or Firm* — Morgan, Lewis & Bockius LLP

(57) ABSTRACT

Disclosed are anti-stick zipper covers, stick-free zippers and tents. An anti-stick zipper cover includes a stiff plastic piece or a coating to increase the stiffness such that the anti-stick zipper cover will not be caught into the teeth of a zipper while zipping on and off the zipper. A tent includes a zipper to couple fabric pieces of the tent cloth and an anti-stick zipper cover to protect the zipper.

9 Claims, 3 Drawing Sheets

(56) References Cited

U.S. PATENT DOCUMENTS

2016/0215512 A1* 7/2016 Workman ..... E04H 15/44

* cited by examiner

ANTI-STICK ZIPPER COVER, STICK-FREE ZIPPER AND TENT HAVING SAME

CROSS-REFERENCE TO RELATED APPLICATIONS

The present application claims priority to Chinese Utility Model Application CN 201720118135.7 filed Feb. 9, 2017. The disclosure of the application is incorporated herein for all purposes by reference in its entirety.

FIELD OF THE INVENTION

The present invention generally relates to zipper covers, zippers and tents, and more particularly, relates to anti-stick zipper covers, stick-free zippers and tents having such stick-free zippers.

BACKGROUND

A typical tent includes a tent frame and a tent cloth coupled to and supported by the tent frame. For the use of the tent, the tent cloth must have some openings such as an entrance to allow a user to get in and out of the tent, or a window for ventilation purposes. In most cases, zippers are used to facilitate the opening and closing of such openings. To prevent water leakage through the zippers on rainy days, covers are used to protect the zippers. Existing covers are made of fabrics for the aesthetic appearance of the tent. Such a fabric cover, however, is often caught by the teeth of the zipper and the zipper gets stuck. Fixing a stuck zipper is time consuming and sometimes frustrating.

Given the current state of the art, there remains a need for anti-stick zipper covers, stick-free zippers and tents incorporating these structures that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides anti-stick zipper covers, stick-free zippers and tents having stick-free zippers.

In various exemplary embodiments, the present invention provides an anti-stick zipper cover for protecting a zipper, which includes a first half chain to be fixedly coupled to a first edge of a first fabric piece, and a second half chain to be fixedly coupled to a second edge of a second fabric piece. The anti-stick zipper cover includes a plastic piece that is stiffer than the first and second fabric pieces to prevent the anti-stuck zipper cover from getting caught by teeth of the zipper when engaging or disengaging the first and second half chains of the zipper.

The anti-stick zipper cover is fixedly disposed at the first fabric piece along at least a portion of the first edge of the first fabric piece or fixedly disposed at the second fabric piece along at least a portion of the second edge of the second fabric piece. The anti-stick zipper cover protects at least a portion of the zipper from exposure to an exterior environment when the first and second half chains of the zipper are engaged with each other. In an exemplary embodiment, the anti-stick zipper cover is sewn to the first or second fabric piece.

In some exemplary embodiments, the plastic piece is made of a material selected from the group consisting of thermoplastic polyurethane (TPU), polypropylene (PP), polyethylene (PE) and polyvinyl chloride (PVC). In an exemplary embodiment, the plastic piece is a plastic mesh. In an exemplary embodiment, the plastic piece is smoothed or flattened by thermal pressing, thereby reducing a chance of the anti-stick zipper cover getting caught by the teeth of the zipper.

In some exemplary embodiments, the anti-stick zipper cover further comprises a fabric cover coupled to the plastic piece at an exterior side of the plastic piece. In an exemplary embodiment, the fabric cover matches to the first fabric piece or the second fabric piece.

In some exemplary embodiments, the anti-stick zipper cover has a width up to 5 centimeters, up to 10 centimeters, or up to 15 centimeters. An exemplary plastic piece has a thickness from about 0.1 millimeters to about 0.25 millimeters. An exemplary fabric cover has a thickness from about 0.05 millimeters to about 0.15 millimeters.

In some exemplary embodiments, the present invention provides an anti-stick zipper cover for protecting a zipper, which includes a first half chain to be fixedly coupled to a first edge of a first fabric piece, and a second half chain to be fixedly coupled to a second edge of a second fabric piece. The anti-stick zipper cover includes a fabric cover, and a coating on an interior surface of the fabric cover to enhance the stiffness of the fabric cover, thereby preventing the zipper from being stuck when engaging or disengaging the first and second half chains of the zipper.

In various exemplary embodiments, the present invention provides a stick-free zipper for coupling first and second fabric pieces. The stick-free zipper includes a zipper and an anti-stick zipper cover of the present invention disclosed herein.

In various exemplary embodiments, the present invention provides a tent including a tent frame and a tent cloth coupled to and supported by the tent frame when the tent is unfolded. The tent cloth includes a first fabric piece, a second fabric piece, a zipper to couple the first and second fabric pieces, and an anti-stick zipper cover of the present invention disclosed herein to protect the zipper.

The first fabric piece is coupled to the tent frame and includes an opening with a first edge. The second fabric piece has a second edge corresponding to the first edge of the first fabric piece. The zipper has a first half chain fixedly coupled to the first edge of the opening of the first fabric piece, and a second half chain fixedly coupled to the second edge of the second fabric piece.

The anti-stick zipper cover is fixedly disposed at the first fabric piece along at least a portion of the first edge of the first fabric piece or fixedly disposed at the second fabric piece along at least a portion of the second edge of the second fabric piece. In an exemplary embodiment, the anti-stick zipper cover is sewn to the first or second fabric piece. The anti-stick zipper cover protects at least a portion of the zipper from exposure to an exterior environment when the first and second half chains of the zipper are engaged with each other. The anti-stick zipper cover is stiffer than the first fabric piece and the second fabric piece to prevent the anti-stick zipper cover from getting caught by teeth of the zipper when engaging or disengaging the first and second half chains of the zipper.

The anti-stick zipper covers, stick-free zippers and tents of the present invention have other features and advantages that will be apparent from, or are set forth in more detail in, the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more exemplary embodiments of the present invention and, together with the Detailed Description, serve to explain the principles and implementations of exemplary embodiments of the invention.

DETAILED DESCRIPTION

Figure 1:
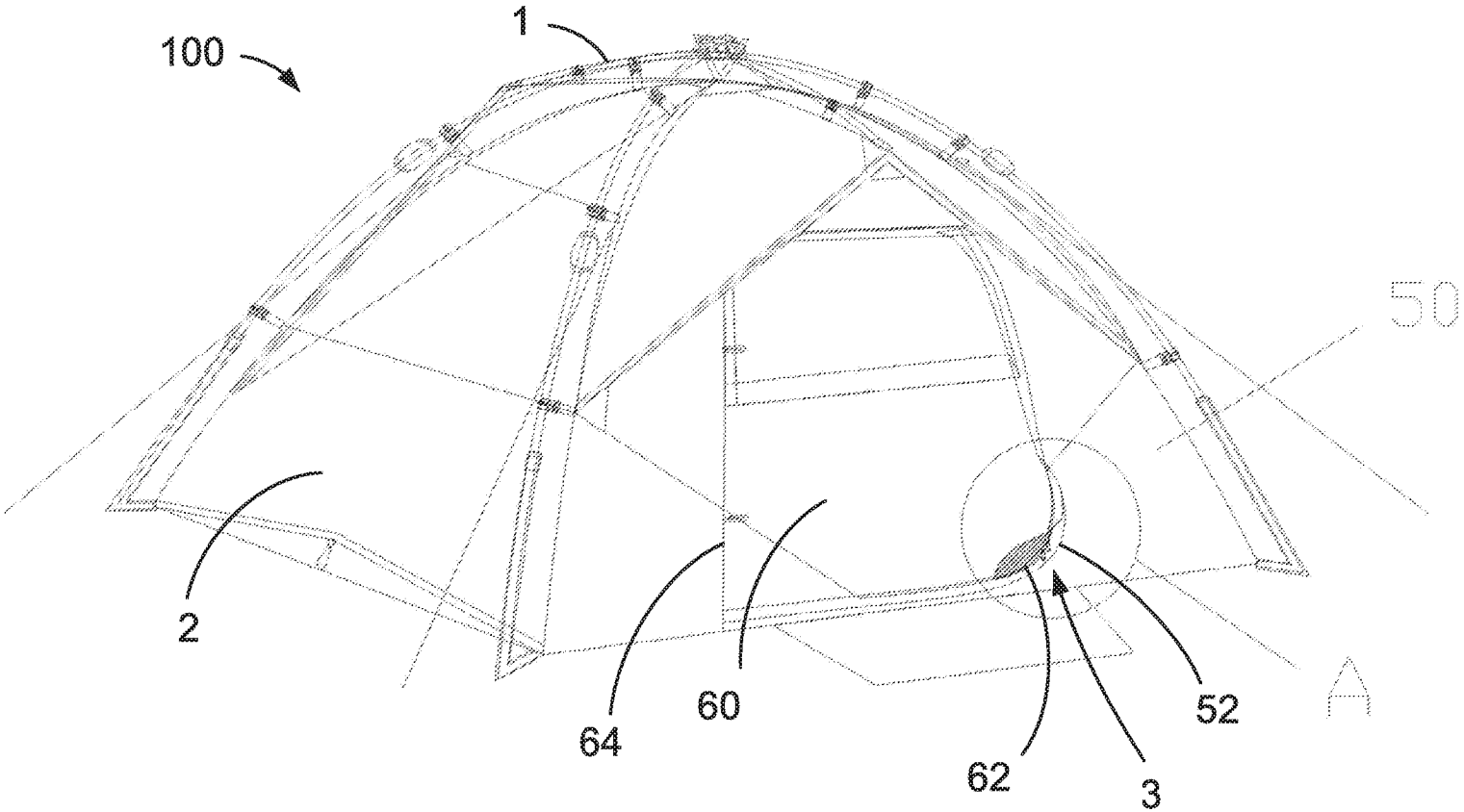
FIG. 1 is a schematic view illustrating an exemplary tent in an unfolded state in accordance with some exemplary embodiments of the present invention.

Reference will now be made in detail to implementations of exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present invention are described in the context of anti-stick zippers covers, stick-free zippers and tents having such stick-free zippers. In general, an anti-stick zipper cover of the present invention is stiffer than the fabric pieces fastened by a zipper to prevent the anti-stick zipper cover from getting caught by the teeth of the zipper and thus significantly reduces the chance of the zipper being stuck while deploying the zipper, i.e., zipping on and off.

A stick-free zipper of the present invention includes a zipper and an anti-stick zipper cover of the present invention disclosed herein to protect the zipper. As such, the stick-free zipper of the present invention is easy and smooth to operate. The zipper can be any suitable type, including but not limited to nylon (coil) chain, metal chain, and plastic chain.

Tents and tent frames of the present invention can be of various sizes and shapes, including, but not limited to, gazebos, domes, shelters and other types of tents. Generally, a tent of the present invention includes a tent cloth with one or more openings and one or more stick-free zippers to facilitate the opening and closing of the one or more openings. Since the chance of the stick-free zippers being stuck while being deployed, i.e., zipping on and off, is eliminated or significantly reduced compared to zippers without anti-stick zipper covers, the tent of the present invention is convenient to use.

Referring now to FIG. 1, there is depicted an exemplary tent in an unfolded state in accordance with some exemplary embodiments of the present invention. Exemplary tent 100 includes a tent frame such as tent frame 1 and a tent cloth such as tent cloth 2 coupled to and supported by the tent frame. Tent cloth 2 includes a first fabric piece such as first fabric piece 50 and a second fabric piece such as second fabric piece 60. First fabric piece 50 has an opening (e.g., an entrance, a ventilation opening, or the like) with first edge 52. By way of example, FIG. 1 illustrates an entrance of tent 100 for allowing a user to enter into and exit the interior of the tent. Corresponding to the first edge of the first fabric piece, second fabric piece 60 has second edge 62. In some exemplary embodiments, the second fabric piece has a third edge such as third edge 64 integrally formed with or sewn to the first fabric piece.

Tent 100 further includes a stick-free zipper such as stick-free zipper 3 that couples the second fabric piece with the first fabric piece. Stick-free zipper 3 engages or disengages at least a portion of the second fabric piece with the first fabric piece, and thus facilitates the opening and closing of the entrance of tent 100.

Figure 2:
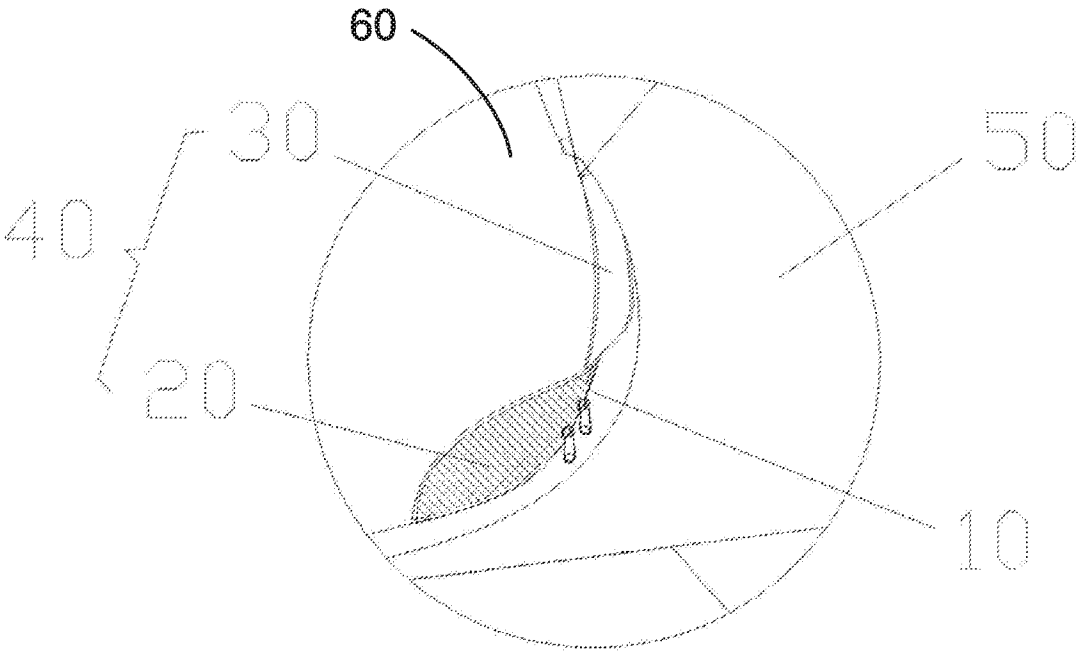
FIG. 2 is a schematic view illustrating an exemplary anti-stick zipper in accordance with some exemplary embodiments of the present invention.
Figure 3:
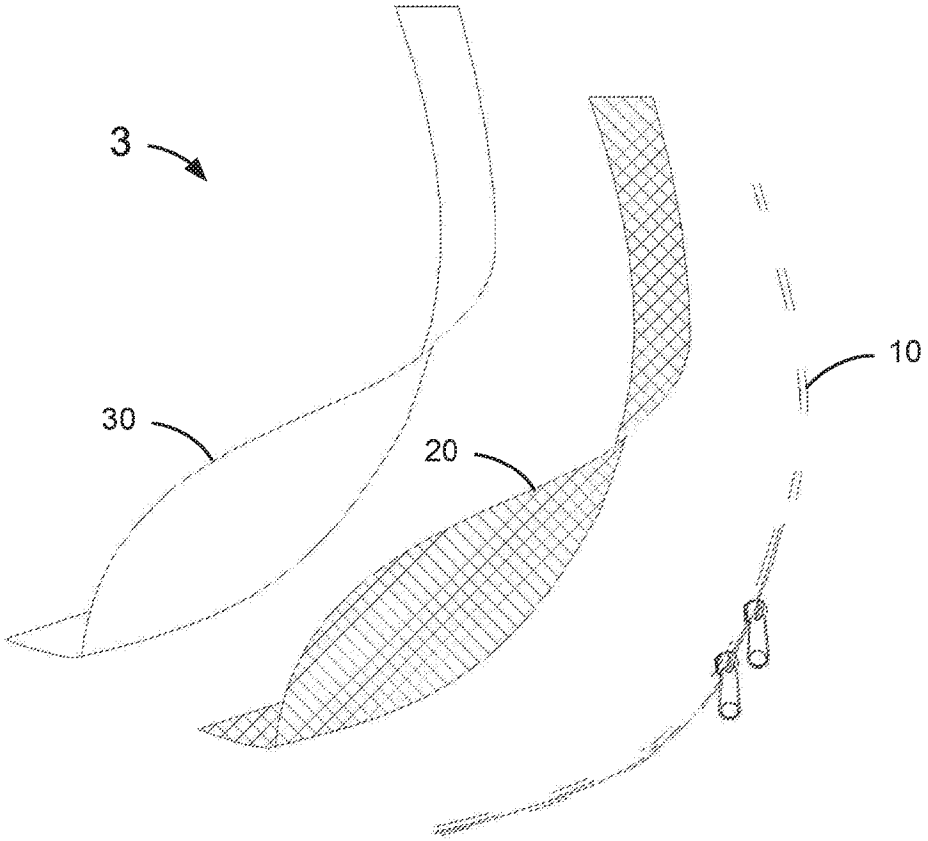
FIG. 3 is an exploded schematic view illustrating the exemplary anti-stick zipper of FIG. 2.

Referring to FIGS. 2 and 3, in various exemplary embodiments, stick-free zipper 3 includes a zipper such as zipper 10 and a zipper cover such as anti-stick zipper cover 40. The zipper has a first half chain fixedly coupled to the first edge of the opening of the first fabric piece, and a second half chain fixedly coupled to the second edge of the second fabric piece. As such, engaging the first and second half chains with each other closes the opening of the first fabric piece; and disengaging the first and second half chains from each other opens the opening of the first fabric piece.

Anti-stick zipper cover 40 can be disposed at either side of the zipper, e.g., at either the first or the second fabric piece. By way of example, FIG. 2 illustrates the anti-stick zipper cover disposed at the second fabric piece. In some exemplary embodiments, the anti-stick zipper cover is sewn to the first or second fabric piece.

In some exemplary embodiments, anti-stick zipper cover 40 has a width up to about 5 centimeters, up to about 10 centimeters, or up to about 15 centimeters. When the first and second half chains of the zipper are engaged with each other, anti-stick zipper cover 40 covers the zipper, protecting the zipper from the environment, e.g., from getting wet, and consequently preventing water leakage into the tent on rainy days.

In some exemplary embodiments, the anti-stick zipper cover is fixedly disposed at the second fabric piece along a portion of the second edge of the second fabric piece (or at the first fabric piece along a portion of the first edge of the first fabric piece) to cover a portion of the zipper that would most likely be exposed to the environment (e.g., rain). In an exemplary embodiment, the anti-stick zipper cover is fixedly disposed at the second fabric piece along the entire length of the second edge of the second fabric piece (or at the first fabric piece along the entire length of the first edge of the first fabric piece) to cover the entire zipper.

In various exemplary embodiments, anti-stick zipper cover 40 is stiff and will not be caught in the teeth of the zipper when engaging or disengaging the first and second half chains of the zipper. As such, a zipper with anti-stick zipper cover 40 will not be jammed by the anti-stick zipper cover when engaging or disengaging the first and second half chains of the zipper. In some exemplary embodiments, anti-stick zipper cover 40 is stiffer than the first fabric piece and the second fabric piece.

In some exemplary embodiments, anti-stick zipper cover 40 includes a plastic piece such as plastic piece 20. Plastic piece 20 is stiffer than the first fabric piece and the second fabric piece. Plastic piece 20 can be made of any suitable materials including but not limited to thermoplastic polyurethane (TPU), polypropylene (PP), polyethylene (PE) and polyvinyl chloride (PVC), or any combination thereof. Plastic piece 20 can be of any suitable configurations including but not limited to a mesh, a film or the like. In an exemplary embodiment, the plastic piece is smoothed or flattened by thermal pressing, thereby reducing the chance of the anti-stick zipper cover getting caught by the teeth of the zipper. In some exemplary embodiments, the plastic piece has a thickness between 0.1 millimeters and 0.25 millimeters.

In some exemplary embodiments, anti-stick zipper cover 40 further includes a fabric cover such as fabric cover 30 coupled to the plastic piece at an exterior side of the plastic piece. In other words, the plastic piece is located between the zipper and the fabric cover. In an exemplary embodiment, the fabric cover and the plastic cover are first sewn together to make the anti-stick zipper cover, and then the anti-stick zipper cover and the zipper are sewn onto the first or second fabric piece of the tent cloth.

In some exemplary embodiments, the fabric cover matches to the first fabric piece or the second fabric piece or both of the first and second fabric pieces. For instance, in an exemplary embodiment, the fabric cover, the first fabric piece and/or the second fabric piece are made of the same material. In some exemplary embodiments, the fabric cover has a thickness of from about 0.05 millimeters to about 0.15 millimeters.

Alternatively, in some exemplary embodiments, the anti-stick zipper cover does not include a plastic piece. Instead, the anti-stick zipper cover includes a fabric cover such as fabric cover 30 and a coating coated on the interior surface (e.g., the surface facing the zipper) of the fabric cover to enhance the stiffness of the fabric cover. In an exemplary embodiment, the exterior surface of the fabric cover matches an exterior surface of the first fabric piece or the second fabric piece, for example, being made of the same material as of the first fabric piece or the second fabric piece.

As disclosed herein, the anti-stick zipper cover of the present invention is stiff to prevent it from getting caught by the teeth of the zipper, and thus significantly reduces the chance of the zipper being stuck while zipping it on and off. The stick-free zipper of the present invention includes an anti-stick zipper cover; accordingly, operation of the stick-free zipper is easy and smooth. The tent of the present invention includes one or more stick-free zippers of the present invention, making it convenient to use. For instance, it is easy and smooth to open and close the entrance of the tent.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "interior" and "exterior", etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first fabric piece could be termed a second fabric piece, and, similarly, a second fabric piece could be termed a first fabric piece, without changing the meaning of the description, so long as all occurrences of the "first fabric piece" are renamed consistently and all occurrences of the "second fabric piece" are renamed consistently.

What is claimed is:

1. A tent comprising:

a tent frame; and a tent cloth coupled to and supported by the tent frame when the tent is unfolded, wherein the tent cloth comprises:

a first fabric piece coupled to the tent frame and comprising an opening, wherein the opening has a first edge;

a second fabric piece having a second edge corresponding to the first edge of the first fabric piece;

a zipper having a first half chain fixedly coupled to the first edge of the opening of the first fabric piece, and a second half chain fixedly coupled to the second edge of the second fabric piece; and an anti-stick zipper cover fixedly disposed at the first fabric piece along at least a portion of the first edge of the first fabric piece or fixedly disposed at the second fabric piece along at least a portion of the second edge of the second fabric piece, wherein the anti-stick zipper cover is disposed at an exterior side of the tent to protect at least a portion of the zipper from exposing to an exterior environment when the first and second half chains of the zipper are engaged with each other, and wherein the anti-stick zipper cover comprises:

a plastic piece that is stiffer than the first fabric piece and the second fabric piece to prevent the anti-stick zipper cover from getting caught by teeth of the zipper when engaging or disengaging the first and second half chains of the zipper, and a fabric cover coupled to the plastic piece at an exterior side of the plastic piece, wherein the fabric cover has a shape and a size substantially the same as the plastic piece.

2. The tent of claim 1, wherein the plastic piece is made of a material selected from the group consisting of thermoplastic polyurethane (TPU), polypropylene (PP), polyethylene (PE) and polyvinyl chloride (PVC).

3. The tent of claim 1, wherein the plastic piece is a plastic mesh.

4. The tent of claim 1, wherein the plastic piece is smoothened or flattened by thermal pressing, thereby reducing a chance of the anti-stick zipper cover getting caught by the teeth of the zipper.

5. The tent of claim 1, wherein the fabric cover matches to the first fabric piece or the second fabric piece.

6. The tent of claim 1, wherein the second fabric piece has a third edge that is integrally formed with or sewn to the first fabric piece.

7. The tent of claim 1, wherein the anti-stick zipper cover is sewn to the first fabric piece or to the second fabric piece.

8. The tent of claim 1, wherein the plastic piece has a thickness from about 0.1 millimeters to about 0.25 millimeters, and the fabric cover has a thickness from about 0.05 millimeters to about 0.15 millimeters.

9. The tent of claim 1, wherein the anti-stick zipper cover has a width up to about 5 centimeters, up to about 10 centimeters, or up to about 15 centimeters.

* * * * *